US011261568B2

(12) United States Patent
Rouse et al.

(10) Patent No.: US 11,261,568 B2
(45) Date of Patent: Mar. 1, 2022

(54) HIGH BULK WET-PRESSED AGAVE TISSUE

(71) Applicant: Kimberly-Clark Worldwide, Inc., Neenah, WI (US)

(72) Inventors: Kayla Elizabeth Rouse, Appleton, WI (US); Richard Louis Underhill, Neenah, WI (US); Thomas Gerard Shannon, Neenah, WI (US); John Matthew Reiser, Snellville, GA (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 690 days.

(21) Appl. No.: 16/319,903

(22) PCT Filed: Oct. 27, 2016

(86) PCT No.: PCT/US2016/059101
§ 371 (c)(1),
(2) Date: Jan. 23, 2019

(87) PCT Pub. No.: WO2018/080493
PCT Pub. Date: May 3, 2018

(65) Prior Publication Data

US 2019/0249367 A1 Aug. 15, 2019

(51) Int. Cl.

| | |
|---|---|
| ***D21F 11/14*** | (2006.01) |
| ***D21H 11/12*** | (2006.01) |
| ***D21H 27/00*** | (2006.01) |

(52) U.S. Cl.
CPC ..... *D21F 11/14* (2013.01); *D21H 11/12* (2013.01); *D21H 27/00* (2013.01); *D21H 27/002* (2013.01)

(58) Field of Classification Search
CPC ..... D21F 11/12; D21F 11/14; D21F 11/145; D21H 27/00; D21H 27/002; D21H 27/004; D21H 27/005; D21H 27/007
See application file for complete search history.

(56) References Cited

U.S. PATENT DOCUMENTS

| | | | |
|---|---|---|---|
| 6,238,682 | B1 | 5/2001 | Klofta et al. |
| 6,270,878 | B1 | 8/2001 | Wegele et al. |

(Continued)

FOREIGN PATENT DOCUMENTS

| | | |
|---|---|---|
| CA | 2168894 | 8/1997 |
| CN | 104116454 B | 6/2017 |

(Continued)

OTHER PUBLICATIONS

JP H07-197400 Machine Translation (Year: 1995).*

(Continued)

*Primary Examiner* — Zachary M Davis
(74) *Attorney, Agent, or Firm* — Kimberly-Clark Worldwide, Inc.

(57) ABSTRACT

The disclosure provides a wet-pressed tissue product comprising *Agave* fiber and having improved sheet bulk and good cross-machine tensile, toughness and durability properties. Cross-machine properties are significant because tissue products often fail in the cross-machine direction because it is often the weaker of the two product orientations (cross and machine directions). Accordingly, in certain embodiments the present disclosure provides a three-layered single-ply wet-pressed tissue product comprising high-yield *Agave* fibers from the leaves of *Agave tequilana*, Eucalyptus Hardwood Kraft (EHWK) fibers and Northern bleached softwood kraft (NBSK), wherein the high-yield *Agave* fibers comprise at least about 5.0 percent by weight of the tissue product, the product having a CD tensile greater than about 450 g/3" and sheet bulk greater than about 7.0 cc/g.

4 Claims, 1 Drawing Sheet

(56) References Cited

U.S. PATENT DOCUMENTS

| | | | | |
|---|---|---|---|---|
| 6,849,158 | B2 | 2/2005 | Spence et al. | |
| 2003/0121629 | A1 | 7/2003 | Hu | |
| 2003/0127203 | A1* | 7/2003 | Hu | D21H 27/38 162/130 |
| 2004/0118535 | A1 | 6/2004 | Spence et al. | |
| 2007/0298995 | A1 | 12/2007 | Eggers et al. | |
| 2008/0076314 | A1 | 3/2008 | Blanz et al. | |
| 2009/0068633 | A1 | 3/2009 | Cohen et al. | |
| 2010/0087117 | A1 | 4/2010 | Peyras-Carratte et al. | |
| 2011/0027545 | A1 | 2/2011 | Harlacher et al. | |
| 2012/0273147 | A1 | 11/2012 | Edwards et al. | |
| 2018/0002864 | A1 | 1/2018 | Ziegenbein | |
| 2018/0135248 | A1 | 5/2018 | Collins et al. | |
| 2018/0142421 | A1 | 5/2018 | Rouse et al. | |
| 2018/0187377 | A1 | 7/2018 | Ziegenbein | |
| 2019/0046362 | A1 | 2/2019 | Yamada | |
| 2019/0231919 | A1 | 8/2019 | Mehnert et al. | |
| 2020/0253268 | A1 | 8/2020 | Rousseau et al. | |

FOREIGN PATENT DOCUMENTS

| | | | |
|---|---|---|---|
| JP | 7197400 | A2 | 8/1995 |
| WO | 03039244 | A1 | 5/2003 |
| WO | WO2016195625 | A1 | 12/2016 |

OTHER PUBLICATIONS

Co-Pending U.S. Appl. No. 16/324,964, filed Feb. 12, 2019, by Rouse et al. for "High Strength and Low Stiffness Agave Tissue."

Co-Pending PCT Application No. WO/2018/080492 filed Oct. 27, 2016, by Rouse et al. for "Fibrous Structures Comprising Volatile Agave Compounds."

Escoto-Garcia, T. et al., "Fermentative-Chemical and Mechanical Treatment of Agave Bagasse (Agave Tequilana Weber) for its Application in Hand Crafted Paper," Revista Mexicana de Ingenieria Quimica, Nov. 30, 2006, vol. 5, No. Suppl. 1, pp. 23-27.

Ghosh, A. K., "Fundamentals of Paper Drying—Theory and Application from Industrial Perspective," Evaporation, Condensation and Heat Transfer, Sep. 12, 2011, pp. 535-582.

Idarraga, G. et al., "Pulp and Paper from Blue Agave Waste from Tequila Production," Journal of Agricultural and Food Chemistry, vol. 47, No. 10, Sep. 4, 1999, pp. 4450-4455.

Iniguez-Covarrubias, G. et al., "Utilization of by-Products from the Tequila Industry. Part 2: Potential Value of Agave Tequilana Weber Azul Leaves," Bioresource Technology, vol. 77, No. 2, Jan. 4, 2001, pp. 101-108.

Jaouadi, M. et al., "A Study of the Physical and Mechanical Properties of Paper Made from *Agave americana* L. Fibers," Materials and Manufacturing Processes, vol. 26, No. 4, Apr. 22, 2011, pp. 567-572.

Iniguez-Covarrubias et al., in "Utilization of byproducts from the tequila industry: part 1: agave bagasse as a raw material for animal feeding and fiberboard production" Bioresource Technology, vol. 77, pp. 25-32 (Year: 2001).

Lopez-Romero et al. in "Biological activities of Agave by-products and their possible applications in food and pharmaceuticals", Journel of Sci Food Agric, pp. 1-14. (Year: 2017).

* cited by examiner

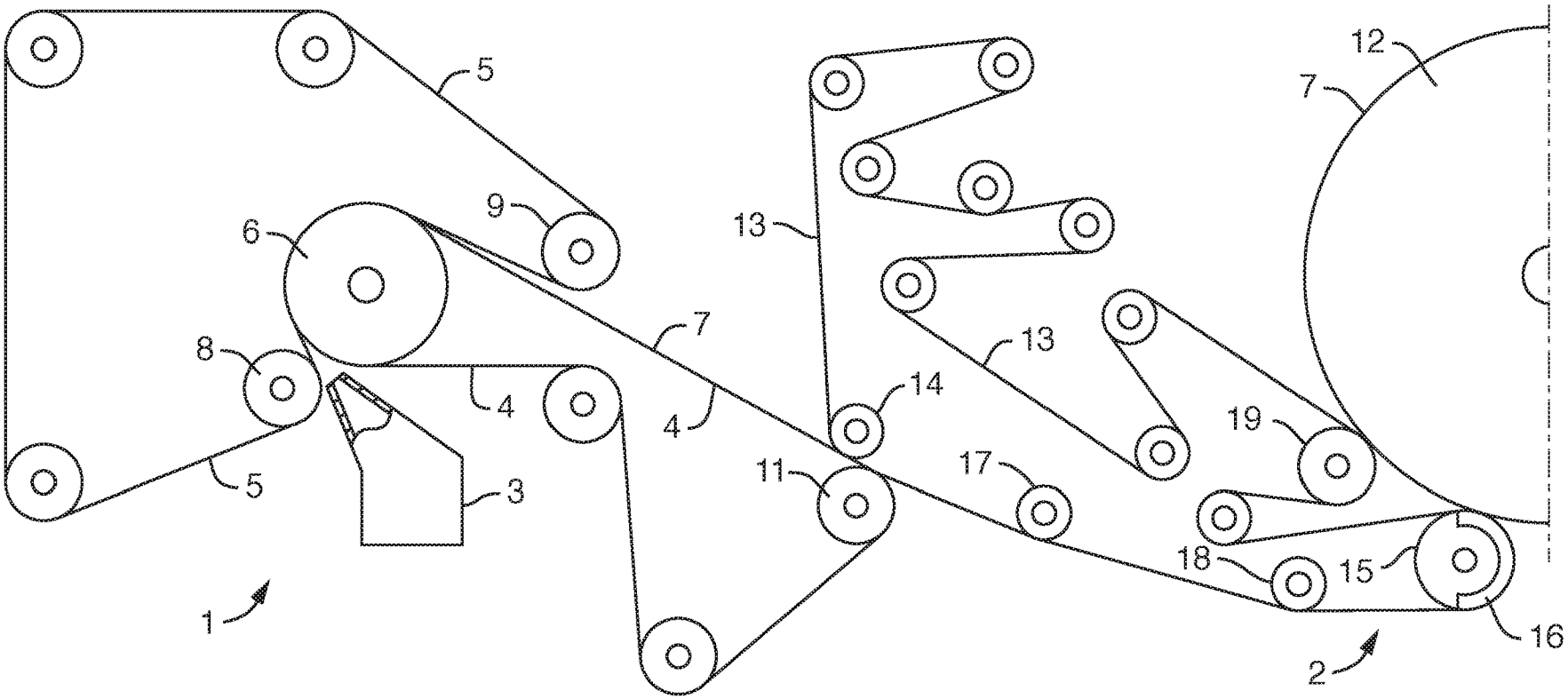
16
12
7
15
2
19
18
13
17
14
13
11
7
4
9
4
3
5
6
8
5
1

HIGH BULK WET-PRESSED AGAVE TISSUE

BACKGROUND OF THE DISCLOSURE

In the manufacture of tissue products, such as facial tissue, bath tissue, paper towels and the like, the tissue sheet is formed by depositing an aqueous suspension of papermaking fibers onto a forming fabric. The web is then transferred to a papermaking felt and dewatered as it passes through a pressure nip created between a pressure roll and a Yankee dryer as the wet web is transferred to the Yankee surface. Free water expressed from the web in the pressure nip is absorbed and carried away by the felt as the web transfers to the Yankee surface. The web is then final dried on the surface of the Yankee and subsequently creped to impart bulk and softness to the resulting tissue sheet. This method of making tissue sheets is commonly referred to as "wet-pressing" because of the method used to dewater the wet web.

The wet-pressing method has several distinct drawbacks. First, pressing the tissue web while wet densifies the web. Second, to restore a portion of the original web density it is necessary to crepe the web, which requires a large amount of energy to dry the web from a consistency of about 35 percent to a final dryness of about 95 percent. Third, because the web is densified by wet pressing immediately prior to drying, there is limited opportunity to impart structure to the web, which limits the tissue maker's ability to increase the sheet bulk or modify the cross-machine direction properties of the web. As such, wet-pressed tissue products typically have relatively modest sheet bulk and relatively cross-machine direction properties, such as stretch and tensile energy absorption.

Therefore there is a need for a method of making wet-pressed tissue sheets having improved sheet bulk and cross-machine direction properties, such as increased cross-machine direction stretch and tensile energy absorption.

SUMMARY OF THE DISCLOSURE

The present disclosure provides wet-pressed tissue products having improved product properties and more particularly improved sheet bulk while maintaining or improving cross-machine properties such as tensile, stretch and tear. Sheet bulk is significant as it generally confers volume and improved hand feel to the tissue product and in-turn the perception of softness. Cross-machine direction (CD) properties are similarly important because tissue products often fail in the cross-machine direction because it is often the weaker of the two product orientations (cross and machine directions). Surprisingly these improvements are brought about by substituting a portion of the long fiber fraction of the papermaking furnish with a non-wood fiber and more specifically *Agave* fiber. Despite having a shorter fiber length than the displaced long wood pulp fibers, the *Agave* fibers were able to maintain or improve important CD properties while improving sheet bulk.

Accordingly, in one embodiment the present disclosure provides a wet-pressed tissue product having increased sheet bulk, the product comprising at least about 5.0 percent, by weight of the product, *Agave* fibers, wherein the product has a sheet bulk at least 10 percent greater than, and CD tensile strength not 10 percent less than, a comparable wet-pressed tissue product substantially free of *Agave* fiber.

In other embodiments the present invention provides a wet-pressed tissue product comprising at least about 5.0 percent, by weight of the tissue product, high yield *Agave* fiber, and less than about 20 percent, by weight of the tissue product, long wood fiber, the tissue product having a sheet bulk greater than about 7.0 cc/g and a CD tear index greater than about 1.0.

In another embodiment the present invention provides a wet-pressed tissue product comprising at least about 5.0 percent, by weight of the tissue product, high yield *Agave* fiber, and comprising from about 0 to about 20 percent, by weight of the tissue product, Northern Softwood Kraft (NSWK) or Southern Softwood Kraft (SSWK), the tissue product having a sheet bulk greater than about 7.0 cc/g, a Stiffness Index less than about 15.0 and a CD tear index greater than about 1.0.

In yet another embodiment the present invention provides a wet-pressed tissue product comprising at least about 5.0 percent, by weight of the tissue product, high yield *Agave* fiber, the tissue product having a CD stretch greater than about 5.0 percent and a Stiffness Index less than about 10.0.

In still other embodiments the present invention provides a single-ply wet-pressed tissue product comprising at least about 5.0 percent, by weight of the tissue product, *Agave* fibers, the product having a CD tensile greater than about 450 g/3" and sheet bulk greater than about 7.0 cc/g.

In other embodiments the present invention provides a single-ply wet-pressed tissue product having a basis weight from about 15 to about 20 gsm, a CD stretch greater than about 5.0 percent, and CD tear index greater than about 1.0, the tissue product comprising at least about 5.0 percent, by weight of the tissue product, high yield *Agave* fiber.

In still other embodiments the present disclosure provides a method of producing a tissue product having improved sheet bulk, the method comprising the steps of dispersing *Agave* fibers to form a first fibrous slurry, dispersing wood pulp fibers to form a second fibrous slurry, pumping the first and second fibrous slurries to a headbox, depositing the first and second fibrous slurries from the headbox onto a foraminous surface to form a fibrous web, pressing the fibrous web against a felt to form a partially dewatered web having a consistency from about 40 to about 50 percent, adhering the partially dewatered web against a Yankee dryer, drying the web to a consistency of greater than about 90 percent and creping the dried web to remove it from the Yankee dryer, and converting the web to a rolled tissue product having a sheet bulk greater than about 7.0 cc/g and a CD tensile greater than about 450 g/3", wherein the tissue product comprises at least about 5.0 percent, by weight of the tissue product, *Agave* fiber.

In yet other embodiments the present disclosure provides a method of producing a tissue product having improved sheet bulk, the method comprising the steps of dispersing *Agave* fibers to form a first fibrous slurry, dispersing wood pulp fibers to form a second fibrous slurry, pumping the first and second fibrous slurries to a multi-channel headbox, depositing the first and second fibrous slurries from the multi-channel headbox onto a foraminous surface to form a multi-layered fibrous web, pressing the multi-layered fibrous web against a felt to form a partially dewatered web having a consistency from about 40 to about 50 percent, adhering the partially dewatered web against a Yankee dryer, drying the web to a consistency of greater than about 90 percent and creping the dried web to remove it from the Yankee dryer, and converting the web to a rolled tissue product having a sheet bulk greater than about 7.0 cc/g and a CD tensile greater than about 450 g/3".

In still other embodiments the present disclosure provides a method of increasing the sheet bulk of a wet-pressed tissue product, the method comprising the steps of forming a wet pressed tissue web comprising at least about 5.0 percent, by weight of the web, *Agave* fiber and converting the web to a rolled tissue product having a sheet bulk greater than about 7.0 cc/g and a CD tensile greater than about 450 g/3", wherein the tissue product sheet bulk is at least about 5.0 percent greater than a comparable tissue product substantially free from *Agave* fibers.

DESCRIPTION OF THE DRAWINGS

FIG. 1 is a schematic representation of a wet-pressed tissue machine useful in the manufacture of the instant tissue webs and products.

DEFINITIONS

As used herein the term "wet-pressed tissue" generally refers to a tissue product manufactured by a wet-pressed method in which prior to the nascent tissue web being transferred to the surface of a rotating drying cylinder, such as a Yankee dryer, water is expressed from the web and absorbed by a felt. The dewatered web, typically having a consistency of about 40 percent, is then dried while on the hot surface of the dryer. The web is then creped from the surface of the dryer.

As used herein the term "Tissue Web" refers to a structure comprising a plurality of fibers such as, for example, papermaking fibers and more particularly pulp fibers, including both wood and non-wood pulp fibers, and synthetic staple fibers. A non-limiting example of a tissue web is a wet-laid sheet material comprising pulp fibers.

As used herein the term "Tissue Product" refers to products made from tissue webs and includes, bath tissues, facial tissues, paper towels, industrial wipers, foodservice wipers, napkins, medical pads, and other similar products. Tissue products may comprise one, two, three or more plies.

As used herein the term "Layer" refers to a plurality of strata of fibers, chemical treatments, or the like within a ply.

As used herein, the terms "Layered Tissue Web," "Multi-Layered Tissue Web," and "Multi-Layered Web," generally refer to sheets of paper prepared from two or more layers of furnish which are preferably comprised of different fiber types. The layers are preferably formed from the deposition of separate streams of dilute furnish, upon one or more endless foraminous screens. If the individual layers are initially formed on separate foraminous screens, the layers are subsequently combined (while wet) to form a layered composite web.

The term "Ply" refers to a discrete product element. Individual plies may be arranged in juxtaposition to each other. The term may refer to a plurality of web-like components such as in a multi-ply facial tissue, bath tissue, paper towel, wipe, or napkin.

As used herein, the term "Basis Weight" generally refers to the bone dry weight per unit area of a tissue and is generally expressed as grams per square meter (gsm). Basis weight is measured using TAPPI test method T-220.

As used herein, the term "Burst," "Burst Strength," and "Dry Burst" generally refer to a measure of the ability of a fibrous structure to absorb energy and is measured as described in the Test Methods section below. While the burst strength of the instant tissue products may vary, generally tissue products prepared according to the present disclosure have a burst strength greater than about 250 gf, more preferably greater than about 300 gf and still more preferably greater than about 350 gf.

As used herein, the term "CD tear Index" refers to the CD tear Strength (typically expressed in grams) at a given CD tensile strength (typically having units of g/3") as defined by the equation:

$$CD\ \text{Tear Index} = \frac{CD\ \text{Tear}\ (g)}{CDT(g/3'')} \times 100$$

While the CD tear Index may vary, tissue products prepared according to the present disclosure generally have a CD tear Index greater than about 1.0, more preferably greater than about 1.10, and still more preferably greater than about 1.25.

As used herein, the term "Caliper" is the representative thickness of a single sheet (caliper of tissue products comprising two or more plies is the thickness of a single sheet of tissue product comprising all plies) measured in accordance with TAPPI test method T402 using an EMVECO 200-A Microgage automated micrometer (EMVECO, Inc., Newberg, Oreg.). The micrometer has an anvil diameter of 2.22 inches (56.4 mm) and an anvil pressure of 132 grams per square inch (per 6.45 square centimeters) (2.0 kPa).

As used herein, the term "Sheet Bulk" refers to the quotient of the caliper (μm) divided by the bone dry basis weight (gsm). The resulting sheet bulk is expressed in cubic centimeters per gram (cc/g). Tissue products prepared according to the present invention generally have a sheet bulk greater than about 7.0 cc/g, more preferably greater than about 8.0 cc/g and still more preferably greater than about 9.0 cc/g. Generally the wet-pressed tissue products of the present invention have a sheet bulk that is at least about 10 percent greater than similarly prepared wet-pressed tissue products that do not comprise *Agave* fiber and more preferably at least about 15 percent greater and still more preferably at least about 20 percent greater.

As used herein, the term "Fiber Length" refers to the length weighted average length of fibers determined utilizing a Kajaani fiber analyzer model No. FS-100 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001 percent solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i \times n_i)/n$$

where k=maximum fiber length
$x_i$=fiber length
$n_i$=number of fibers having length $x_i$
n=total number of fibers measured.

As used herein the term "Fiber" means an elongate particulate having an apparent length greatly exceeding its apparent width. More specifically, and as used herein, fiber refers to such fibers suitable for a papermaking process and more particularly the tissue paper making process.

As used herein, the term "*Agave* Fiber" refers to a fiber derived from a plant of the genus *Agave* of the family Asparagaceae including, for example, *Agave tequilana,*

*Agave sisalana* and *Agave fourcroydes*. The fibers are generally processed into a pulp for use in the manufacture of tissue products according to the present invention.

As used herein the term "Wood Fiber" refers to a fiber derived from a vascular plant having secondary growth, including for example woody plants such as hardwoods and softwoods.

As used herein the term "Furnish" generally refers to a slurry of one or more fibers useful in the manufacture of tissue webs.

As used herein, the term "Long Wood Fiber" refers wood fibers having an average fiber length of at least about 2.0 mm. Long wood fiber may be useful in forming tissue products of the present invention and may comprise a portion of the papermaking furnish. Suitable long wood fiber for use in the invention may include, for example, softwood fibers such as Northern Softwood Kraft (NSWK) fibers or Southern Softwood Kraft (SSWK) fibers.

As used herein, the term "Short Wood Fiber" refers to wood fibers having an average fiber length less than about 2.0 mm, such as from about 0.5 to about 2.0 mm and more preferably from about 0.75 to about 1.5 mm. Short wood fiber may be useful in forming tissue products of the present invention and may comprise a portion of the papermaking furnish. Suitable short wood fiber for use in the invention may include, for example, hardwood fibers such as Eucalyptus Hardwood Kraft (EHWK) fibers.

As used herein, the term "Slope" refers to slope of the line resulting from plotting tensile versus stretch and is an output of the MTS TestWorks™ in the course of determining the tensile strength as described in the Test Methods section herein. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width. Slopes are generally reported herein as having units of kilograms per sample width, such as kg/3".

As used herein, the term "Geometric Mean Slope" (GM Slope) generally refers to the square root of the product of machine direction slope and cross-machine direction slope. GM Slope generally is expressed in units of kg.

As used herein, the terms "Geometric Mean Tensile" (GMT) refers to the square root of the product of the machine direction tensile strength and the cross-machine direction tensile strength of the web.

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (g/3'')} \times 1{,}000$$

While the Stiffness Index may vary, tissue products prepared according to the present disclosure generally have a Stiffness Index less than about 15.0, more preferably less than about 14.0 and still more preferably less than about 13.0.

DETAILED DESCRIPTION OF THE DISCLOSURE

It has now been discovered that the sheet bulk of a wet-pressed tissue product may be improved while maintaining or improving the perceived in-use strength. For example, tissue products prepared according to the present invention generally have bulks greater than about 7.0 cc/g and more preferably greater than about 7.5 cc/g and still more preferably greater than about 8.0 cc/g, such as from about 7.0 to about 11.0 cc/g. Generally the wet-pressed tissue products of the present invention have a sheet bulk that is at least about 10 percent greater than similarly prepared wet-pressed tissue products that do not comprise *Agave* fiber and more preferably at least about 15 percent greater and still more preferably at least about 20 percent greater. The increase in bulk is surprising provided that increasing the bulk of wet-pressed tissue products is difficult provided that the web is compressed during manufacture as it is pressed prior to transfer of the web to the drying cylinder and because non-wood fibers often reduce, rather than increase, sheet bulk.

Not only does the use of *Agave* fibers improve the sheet bulk, the fibers may be used to produce products having CD properties that are comparable or better than those of similarly prepared wet-pressed products without *Agave* fiber. For example, the instant products may have a CD stretch greater than about 5.0, a CD tensile strength greater than about 450 g/3" and a CD tear greater than about 7.0 gf. In particularly preferred embodiments the CD tensile strength may range from about 500 to about 1,000 g/3" and more preferably from about 600 to about 1,000 g/3" and the CD tear index may range from about 1.0 to about 1.25.

In other embodiments the present invention provides a wet-pressed tissue product having improved bulk without a loss of CD tensile strength relative to a comparable wet-pressed tissue product prepared without *Agave* fibers. For example, the invention provides a single-ply wet-pressed tissue product having increased sheet bulk, the product comprising at least about 5.0 percent, by weight of the product, *Agave* fibers, wherein the sheet bulk of the product is at least 10 percent greater than, and CD tensile strength is not 10 percent less than, a comparable tissue product consisting essentially of wood pulp fibers and substantially free of *Agave* fiber. The foregoing tissue product may have a sheet bulk greater than about 7.0 cc/g, such as from about 7.0 to about 11.0 and more preferably from about 8.0 to about 11.0 and still more preferably from about 9.0 to about 11.0 cc/g, a CD tensile strength from about 450 to about 750 g/3".

The improvement of sheet bulk without a corresponding negative affect on important CD properties is generally achieved by forming the tissue product at least in-part from fiber derived from non-wood plants of the genus *Agave*, of the family Asparagaceae, such as *Agave tequilana, Agave sisalana* and *Agave fourcroydes*. The *Agave* fibers are generally incorporated into the instant tissue products as a replacement for a portion of the long fiber fraction of the papermaking furnish, such as NSWK or SSWK. The ability to substitute the long fiber fraction with *Agave* fiber is particularly surprising provided *Agave*'s relatively short fiber length compared to NSWK and SSWK, as illustrated in the table below.

TABLE 1

| Fiber Type | Average Fiber Length (mm) | Average Fiber Width (μm) | Aspect Ratio | Coarseness (mg/100 m) |
|---|---|---|---|---|
| NSWK | 3.5 | 36 | 97 | 21.3 |
| SSWK | 4.0 | 43 | 93 | 14.8 |
| High Yield Agave Fiber | 1.1 | 44 | 25 | 12.7 |

Despite having a substantially shorter fiber length compared to softwood kraft fibers, *Agave* may displace a portion of these fibers in the papermaking furnish and provide tissue products having improved bulk and good CD properties. As such, the tissue webs and products of the present invention generally comprise at least about 5.0 percent, by weight of the web or product, and more preferably at least about 10 percent and still more preferably at least about 15 percent, *Agave* fiber.

The *Agave* fiber may displace a portion of the long wood fiber fraction of the papermaking furnish such that the tissue product or web comprises from about 0 to about 30 percent, by weight of the product or web, wood fibers having an average fiber length greater than about 2.0 mm, such as NSWK or SSWK. In particularly preferred embodiments the invention provides a tissue product comprising from about 1.0 to about 25 percent, by weight of the tissue product, NSWK, and more preferably from about 5.0 to about 20 percent and still more preferably from about 10 to about 15 percent by weight of the tissue product, NSWK.

In certain embodiments the *Agave* fibers are processed by a high yield pulping process, such as mechanically treating the fibers. High yield pulping processes include, for example, mechanical pulp (MP), refiner mechanical pulp (RMP), pressurized refiner mechanical pulp (PRMP), thermomechanical pulp (TMP), high temperature TMP (HT-TMP), RTS-TMP, thermopulp, groundwood pulp (GW), stone groundwood pulp (SGW), pressure groundwood pulp (PGW), super pressure groundwood pulp (PGW-S), thermo groundwood pulp (TGW), thermo stone groundwood pulp (TSGW) or any modifications and combinations thereof. Processing of *Agave* fibers using a high yield pulping process generally results in a pulp having a yield of at least about 50 percent, more preferably at least about 65 percent and still more preferably at least about 85 percent, such as from about 50 about 95 percent and more preferably from about 65 to about 90 percent.

The high yield pulping process may comprise heating the *Agave* fiber above ambient, such as from about 70 to about 200° C., and more preferably from about 90 to about 150° C. while subjecting the fiber to mechanical forces. Caustic or an oxidizing agent may be introduced to the process to facilitate fiber separation by the mechanical forces. For example, in one embodiment, a solution of 3 to about 8 percent NaOH and a solution of 3 to about 8 percent peroxide may be added to the fiber during mechanical treatment to facilitate fiber separation.

In other embodiments the high yield pulping process may comprise treating *Agave* leaves with an alkaline pulping solution such as that disclosed in U.S. Pat. No. 6,302,997, the contents of which are incorporated herein in a manner consistent with the present disclosure. Alkaline treatment may be carried out at a pressure from about atmospheric pressure to about 30 psig and at a temperature ranging from about ambient temperature to about 150° C. The alkaline hydroxide may be added, based upon the oven dried mass of the *Agave* leaves, from about 10 to about 30 percent. Suitable alkaline pulping solutions include, for example, sodium hydroxide, potassium hydroxide, ammonium hydroxide, calcium hydroxide and combinations thereof. After alkaline treatment, the *Agave* is mechanically worked and then treated with an acid solution to reduce the pH to an acid pH.

In other embodiments the high yield pulping process may comprise impregnating *Agave* leaves with a solution of nitric acid and optionally ammonium hydroxide at ambient temperatures under atmospheric pressure, such as described in U.S. Pat. No. 7,396,434, the contents of which are incorporated herein in a manner consistent with the present invention. The impregnated leaves are then heated to evaporate the nitric acid followed by treatment with an alkaline solution before being cooled.

Although a caustic, such as NaOH, or oxidizing agent, such as nitric acid or peroxide, may be added during processing, it is generally preferred that the *Agave* fiber is not pretreated with a sodium sulfite or the like prior to processing. For example, high yield *Agave* pulps are generally prepared without pretreatment of the fiber with an aqueous solution of sodium sulfite or the like, which is commonly employed in the manufacture of chemi-mechanical wood pulps.

The use of *Agave* fiber, and in a particularly preferred embodiment high yield *Agave* pulp fibers, results in tissue webs and products having favorable physical properties. Surprisingly the physical properties are comparable or better than the physical properties of commercial wet-pressed tissue products produced from a blend of long and short wood pulp fibers. Accordingly, in certain embodiments tissue products prepared according to the present disclosure generally comprise a single ply and are manufactured by a wet-pressed process.

The tissue products generally have a basis weight greater than about 10 grams per square meter (gsm), for example from about 10 to about 40 gsm and more specifically from about 15 to about 35 gsm. In certain embodiments the present disclosure provides a single-ply wet-pressed tissue product having a basis weight from about 10 to about 20 gsm, such as from about 15 to about 18 gsm.

At the foregoing basis weights tissue products prepared according to the present disclosure have geometric mean tensile (GMT) strengths greater than about 450 g/3", such as from about 450 to about 1,200 g/3" and more specifically from about 700 to about 1,000 g/3".

Surprisingly the use of *Agave* fibers to form a portion of the fiber furnish used to produce wet-pressed tissue products according to the present invention may increase the product's sheet bulk. For example, the addition of 5.0 to 30 percent, by weight of the product, *Agave* fibers may increase the sheet bulk by at least about 10 percent, and in certain instances by about 15 percent and in still other instances by about 20 percent, compared to a similar wet-pressed tissue product consisting entirely of wood pulp fibers and substantially free from *Agave* fibers. Accordingly, in certain embodiments the *Agave* tissue products of the present invention comprise from about 5.0 to about 30 percent, by weigh to of the product, *Agave* fibers and have a sheet bulk greater than about 7.0 cc/g and more preferably greater than about 8.0 cc/g, and still more preferably greater than about 9.0 cc/g, such as from about 7.0 to about 11.0 cc/g.

In addition to having improved sheet bulks, the instant tissue products have favorable CD properties, such as a CD stretch greater than about 4.0 percent, such as from about 4.0 to about 8.0 percent. Generally, at the foregoing levels of CD stretch the tissue products also have relatively high CD tensile strength, such as greater than about 450 g/3", such as from about 450 to about 800 g/3". In a particularly preferred embodiment the tissue products have a CD stretch from about 5.0 to about 8.0 percent and a CD tensile strength from about 500 to about 700 g/3". At these levels of CD tensile strength and CD stretch the tissue products of the present disclosure are highly durable, particularly in what is generally the weakest orientation of the tissue product—the cross machine direction. Accordingly, tissue products of the present disclosure generally withstand use better than prior art tissue products; particularly single-ply wet-pressed tissue products.

In addition to providing good CD stretch and tensile strength the instant tissue products also provide good CD tear properties. For example, the use of *Agave* fibers may improve the CD tear compared to comparable products prepared entirely from wood pulp fibers. As such the CD tear of the instant tissue products is generally greater than about 6.0 gf, such as from about 6.0 to about 10.0 gf and more specifically from about 7.0 to about 9.0 gf. At foregoing tear strengths the CD tear index is generally greater than about 1.0 and more preferably greater than about 1.1 and still more preferably greater than about 1.25. The improvements in CD tear strength further contributes to the overall improvement in the toughness and durability of the tissue product.

The favorable cross-machine direction properties achieved by the use of *Agave* fibers, such as tensile strength, stretch and tear generally yield a tissue product having improved durability and toughness that holds up better in-use compared to other wet-pressed tissue products. The increased durability may be reflected in improved dry burst strength, such as a tissue product having a burst strength greater than about 250 gf, more preferably greater than about 300 gf and still more preferably greater than about 350 gf, such as from about 250 to about 500 gf. In certain instances the dry burst strengths of the inventive tissue products is at least about 10 percent, and more preferably at least about 15 percent, greater than a comparable tissue product consisting essentially of wood pulp fibers and substantially free of *Agave* fiber.

In still other embodiments the inventive wet-pressed tissue products have a basis weight from about 16 to about 20 gsm, a sheet bulk greater than about 7.0 cc/g, such as from about 7.0 to about 11.0 cc/g and more preferably from about 8.0 to about 11.0 cc/g and still more preferably from about 9.0 to about 11.0 cc/g, a CD tensile strength from about 450 to about 750 g/3" and a CD tear index greater than about 1.0 and more preferably greater than about 1.1, such as from about 1.1 to about 1.25 and a burst strength from about 250 to about 500 gf and more preferably from about 350 to about 500 gf.

Generally the base webs and tissue products of the present disclosure are prepared by a wet-pressed tissue manufacture, such as that illustrated in FIG. 1. The paper machine shown is a twin wire machine comprising a wet end 1 and a dry section 2. The wet end includes a headbox 3, a movable carrying forming wire 4, a movable covering forming wire 5 and a forming roll 6 which may be perforated and provided with suction means. Alternatively, the forming roll may be smooth. The headbox 3 supplies a single- or multi-layer flow of stock between the two moving forming wires 4, 5 for forming a paper web 7 by dewatering the stock. The two forming wires 4, 5 run together over the forming roll 6 and then in individual loops over a plurality of rolls arranged to impel, guide, align and stretch the carrying forming wire 4 and the covering forming wire 5. The rolls defining the path of the covering forming wire 5 include a breast roll 8 and, a short way after the forming roll 6, a guide roll 9 which can be termed a forward drive roll. The covering forming wire 5 leaves the carrying forming wire 4 and the paper web 7 either immediately before the wire 4 and paper web 7 diverge from the forming roll 6, or at a transfer suction box, not shown, or other transfer means located between forming roll 6 and forward drive roll 9. The carrying forming wire 4 runs to the drying section 2 where it leaves the paper web 7 by changing its direction of travel around a guide roll 11.

The drying section 2 comprises a Yankee dryer 12 having a relatively large diameter and a polished cylindrical surface. The Yankee dryer 12, preferably consisting of a cylinder covered by a hood (not shown), in which hot air is blown at high speed against the paper web 7. The paper web is creped from the Yankee dryer 12 by means of a creping doctor (not shown) to obtain the desired creping, after which the finished creped paper web is wound onto a roll. Further, the drying section 2 includes a felt 13 disposed upstream of the Yankee dryer 12 and travelling in a loop around several rolls and around a pick-up means, suitably in the form of a roll 14, located nearest the wet end 1 and thereby in the vicinity of said guide roll 11 for the carrying forming wire 4, and a press roll 15 which presses against the Yankee dryer 12 and is provided with suction means 16 to dewater the paper web before the latter comes into contact with the Yankee dryer 12. The pick-up means may alternatively consist of a shoe. Further, two guide rolls 17, 18 are disposed between the pick-up roll 14 and press roll 15, said guide rolls 17, 18 deflecting with a small angle the direction of travel of the felt 13. A blind-drilled roll 19 is disposed after the press roll 15, in contact with Yankee dryer. The paper web 7 is transferred to the felt 13 at the point where this and the carrying forming wire 4 converge at the pick-up roll 14 and thereafter immediately diverge from each other. Suitable conditioning means (not shown) are disposed along the loop of the felt 13 in order to condition the felt prior to contact with the paper web.

As described above the web is mechanically dewatered by a compression nip while the wet web is in contact with a papermaking felt and thereafter dried with the aid of a Yankee dryer. As used herein, a "felt" is an absorbent papermaking fabric designed to absorb water and remove it from a tissue web. Papermaking felts of various designs are well known in the art. The water expressed from the wet web during compression is absorbed and carried away by the felt. Commonly, the compression nip is formed between a press roll and the surface of the Yankee dryer. Particularly suitable wet-pressed tissue products in accordance with this invention are mechanically dewatered, final-dried on a Yankee dryer and once-creped.

Preferably the formed web is dried by transfer to the surface of a rotatable heated dryer drum, such as a Yankee dryer. In accordance with the present disclosure, the creping composition may be applied topically to the tissue web while the web is traveling on the fabric or may be applied to the surface of the dryer drum for transfer onto one side of the tissue web. In this manner, the creping composition is used to adhere the tissue web to the dryer drum. In this embodiment, as the web is carried through a portion of the rotational path of the dryer surface, heat is imparted to the web causing most of the moisture contained within the web to be evaporated. The web is then removed from the dryer drum by a creping blade. Creping the web, as it is formed, further reduces internal bonding within the web and increases softness. Applying the creping composition to the web during creping, on the other hand, may increase the strength of the web.

In a particularly preferred embodiment the formed web is transferred to the surface of the Yankee dryer by a suction pressure roll. Particularly suitable press loads for purposes of this invention can have a peak pressure of about 1.4 MPa or greater, more specifically from about 4 to about 8 MPa, and still more specifically from about 4 to about 6 MPa. The wet tissue web can be dewatered to a consistency of about 30 percent or greater, more specifically about 40 percent or greater, more specifically from about 40 to about 50 percent, and still more specifically from about 45 to about 50 percent. As used herein and well understood in the art, "consistency" refers to the bone dry weight percent of the web based on fiber.

In order to adhere the web to the surface of the dryer drum, a creping adhesive may be applied to the surface of the dryer drum by a spraying device. The spraying device may emit a creping composition made in accordance with the present disclosure or may emit a conventional creping adhesive. The web is adhered to the surface of the dryer drum and then creped from the drum using the creping blade. If desired, the dryer drum may be associated with a hood. The hood may be used to force air against or through the web.

In certain embodiments the single ply webs made according to the present disclosure can be incorporated into multiple-ply products. For instance, in one aspect, a single ply wet pressed web made according to the present disclosure can be attached to one or more other fibrous webs for forming a tissue product having desired characteristics, such as improved bulk, good tensile strength and relatively low stiffness. The other webs laminated to the single-ply webs of the present disclosure can be, for instance, a wet-creped web, a calendered web, an embossed web, a through-air dried web, a creped through-air dried web, an uncreped through-air dried web, an airlaid web, and the like. In other embodiments two or more single-ply webs of the present disclosure are plied together to form a multi-ply tissue product.

In multiple-ply products, the basis weight of each fibrous web present in the product may vary. In general, the total basis weight of a multiple-ply product will generally be from about 30 to about 60 gsm, such as from about 32 to about 45 gsm, and more preferably from about 35 to about 40 gsm. In particularly preferred embodiments the tissue product is a multi-ply facial tissue wherein each ply has a basis weight from about 15 to about 30 gsm, such as from about 16 to about 22.5 gsm, and more preferably from about 17.5 to about 20 gsm.

Multi-ply tissue products produced according to the present invention may have a GMT greater than about 500 g/3", such as from about 500 to about 900 g/3" and more preferably from about 600 to about 750 g/3". At these strengths, the tissue products generally have GM Slopes less than about 10 kg/3", such as from about 5 to about 9 kg/3", and in particularly preferred embodiments from about 6 to about 8 kg/3". The relatively slow GM Slope and modest GMT yield products having relatively low Stiffness Index, such as less than about 15, for example from about 8 to about 15 and in particularly preferred embodiments from about 10 to about 12. Further, the multi-ply products generally have improved sheet bulk compared to tissue products substantially free from *Agave* fibers, such sheet bulks at least about 10 percent greater and ranging from about 7.0 to about 10.0 cc/g.

Test Methods

All samples are conditioned in accordance with TAPPI test method T402 sp-03 "Standard Conditioning and Testing Atmosphere For Paper, Board, Pulp Handsheets and Related Products" before performing the test methods described below.

Sheet Bulk

Sheet Bulk is calculated as the quotient of the dry sheet caliper (μm) divided by the basis weight (gsm). Dry sheet caliper is the measurement of the thickness of a single tissue sheet measured in accordance with TAPPI test methods T402 and T411 om-89. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

Tensile

Tensile testing was done in accordance with TAPPI test method T-576 "Tensile properties of towel and tissue products (using constant rate of elongation)" wherein the testing is conducted on a tensile testing machine maintaining a constant rate of elongation and the width of each specimen tested is 3 inches. More specifically, samples for dry tensile strength testing were prepared by cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was an MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength of the product or sheet in units of grams of force per 3 inches of sample. The geometric mean tensile (GMT) strength was calculated and is expressed as grams-force per 3 inches of sample width. Tensile energy absorbed (TEA) and slope are also calculated by the tensile tester. TEA is reported in units of gm·cm/cm$^2$. Slope is recorded in units of kg. Both TEA and Slope are directional dependent and thus MD and CD directions are measured independently. Geometric mean TEA and geometric mean slope are defined as the square root of the product of the representative MD and CD values for the given property.

Multi-ply products were tested as multi-ply products and results represent the tensile strength of the total product. For example, a 2-ply product was tested as a 2-ply product and recorded as such. A basesheet intended to be used for a two ply product was tested as two plies and the tensile recorded as such. Alternatively, a single ply may be tested and the result multiplied by the number of plies in the final product to get the tensile strength.

Burst Strength

Burst strength herein is a measure of the ability of a fibrous structure to absorb energy, when subjected to deformation normal to the plane of the fibrous structure. Burst strength may be measured in general accordance with ASTM D-6548 with the exception that the testing is done on a Constant-Rate-of-Extension (MTS Systems Corporation, Eden Prairie, Minn.) tensile tester with a computer-based data acquisition and frame control system, where the load cell is positioned above the specimen clamp such that the penetration member is lowered into the test specimen causing it to rupture. The arrangement of the load cell and the specimen is opposite that illustrated in FIG. 1 of ASTM D-6548. The penetration assembly consists of a semi spherical anodized aluminum penetration member having a diameter of 1.588±0.005 cm affixed to an adjustable rod having a ball end socket. The test specimen is secured in a specimen clamp consisting of upper and lower concentric rings of aluminum between which the sample is held firmly by mechanical clamping during testing. The specimen clamping rings have an internal diameter of 8.89±0.03 cm.

The tensile tester is set up such that the crosshead speed is 15.2 cm/min, the probe separation is 104 mm, the break sensitivity is 60 percent and the slack compensation is 10 gf and the instrument is calibrated according to the manufacturer's instructions.

Samples are conditioned under TAPPI conditions and cut into 127×127 mm±5 mm squares. For each test a total of 3 sheets of product are combined. The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single-ply tissue product, then 3 sheets of product totaling 3 plies are tested.

Prior to testing the height of the probe is adjusted as necessary by inserting the burst fixture into the bottom of the tensile tester and lowering the probe until it was positioned approximately 12.7 mm above the alignment plate. The length of the probe is then adjusted until it rests in the recessed area of the alignment plate when lowered.

It is recommended to use a load cell in which the majority of the peak load results fall between 10 and 90 percent of the capacity of the load cell. To determine the most appropriate load cell for testing, samples are initially tested to determine peak load. If peak load is less than 450 gf a 10 Newton load cell is used, if peak load is greater than 450 gf a 50 Newton load cell is used.

Once the apparatus is set-up and a load cell selected, samples are tested by inserting the sample into the specimen clamp and clamping the test sample in place. The test sequence is then activated, causing the penetration assembly to be lowered at the rate and distance specified above. Upon rupture of the test specimen by the penetration assembly the measured resistance to penetration force is displayed and recorded. The specimen clamp is then released to remove the sample and ready the apparatus for the next test.

The peak load (gf) and energy to peak (g-cm) are recorded and the process repeated for all remaining specimens. A minimum of five specimens are tested per sample and the peak load average of five tests is reported as the burst strength.

Tear

Tear testing was carried out in accordance with TAPPI test method T-414 "Internal Tearing Resistance of Paper (Elmendorf-type method)" using a falling pendulum instrument such as Lorentzen & Wettre Model SE 009. Tear strength is directional and MD and CD tear are measured independently.

More particularly, a rectangular test specimen of the sample to be tested is cut out of the tissue product or tissue basesheet such that the test specimen measures 63 mm±0.15 mm (2.5 inches±0.006 inch) in the direction to be tested (such as the MD or CD direction) and between 73 and 114 millimeters (2.9 and 4.6 inches) in the other direction. The specimen edges must be cut parallel and perpendicular to the testing direction (not skewed). Any suitable cutting device, capable of the proscribed precision and accuracy, can be used. The test specimen should be taken from areas of the sample that are free of folds, wrinkles, crimp lines, perforations or any other distortions that would make the test specimen abnormal from the rest of the material.

The number of plies or sheets to test is determined based on the number of plies or sheets required for the test results to fall between 20 to 80 percent on the linear range scale of the tear tester and more preferably between 20 to 60 percent of the linear range scale of the tear tester. The sample preferably should be cut no closer than 6 mm (0.25 inch) from the edge of the material from which the specimens will be cut. When testing requires more than one sheet or ply the sheets are placed facing in the same direction.

The test specimen is then placed between the clamps of the falling pendulum apparatus with the edge of the specimen aligned with the front edge of the clamp. The clamps are closed and a 20-millimeter slit is cut into the leading edge of the specimen usually by a cutting knife attached to the instrument. For example, on the Lorentzen & Wettre Model SE 009 the slit is created by pushing down on the cutting knife lever until it reaches its stop. The slit should be clean with no tears or nicks as this slit will serve to start the tear during the subsequent test.

The pendulum is released and the tear value, which is the force required to completely tear the test specimen, is recorded. The test is repeated a total of ten times for each sample and the average of the ten readings reported as the tear strength. Tear strength is reported in units of grams of force (gf). The average tear value is the tear strength for the direction (MD or CD) tested. The "geometric mean tear strength" is the square root of the product of the average MD tear strength and the average CD tear strength. The Lorentzen & Wettre Model SE 009 has a setting for the number of plies tested. Some testers may need to have the reported tear strength multiplied by a factor to give a per ply tear strength. For basesheets intended to be multiple ply products, the tear results are reported as the tear of the multiple ply product and not the single-ply basesheet. This is done by multiplying the single-ply basesheet tear value by the number of plies in the finished product. Similarly, multiple ply finished product data for tear is presented as the tear strength for the finished product sheet and not the individual plies. A variety of means can be used to calculate but in general will be done by inputting the number of sheets to be tested rather than number of plies to be tested into the measuring device. For example, two sheets would be two 1-ply sheets for 1-ply product and two 2-ply sheets (4-plies) for 2-ply products.

EXAMPLES

Wet-pressed tissue products were produced substantially as illustrated in FIG. 1. The tissue product was a one-ply product having a basis weight of 18 grams per square meter (gsm). The furnished blend used to produce the tissue products comprised 25 percent Northern bleached softwood kraft (NBSK) and 75 percent eucalyptus hardwood kraft (EHWK). In certain instances tissue products were produced by substituting a portion of the NBSK with high yield *Agave* (HYA) fibers. The HYA was prepared by dispersing about 50 pounds (oven dry basis) HYA pulp in a pulper for 30 minutes at a consistency of about 3 percent. The fiber was then transferred to a machine chest and diluted to a consistency of 1 percent. HYA was produced by processing *Agave tequilana* leafs using a three stage non-wood pulping process commercially available from Taizen America (Macon, Ga.). The resulting high yield *Agave* fiber had an average fiber length of about 1.1 mm and a fiber coarseness of about 12.74 mg/100 m.

The EHWK, NBSK and HYA pulps were repulped separately as different pulping times were required. In certain instances the pulps were refined or wet end chemicals (Redibond™ 2038) were added. When added, wet end chemicals were added to each layer of the three layer tissue base sheet. The Creping adhesive was a mixture of polyvinyl alcohol, water and Kymene®. The crepe ratio was set at 1.20-1.25. Details regarding the composition of the various experimental codes are shown in Table 2, below.

TABLE 2

| Code | EHWK (wt %) | NBSK (wt %) | HYA (wt %) | Redibond ™ 2038 (kg/MT) | NBSK Refining (minutes) |
|---|---|---|---|---|---|
| Control 1 | 75 | 25 | — | 0 | 7 |
| Control 2 | 75 | 25 | — | 2.15 | 7 |
| Control 3 | 75 | 25 | — | 5.15 | 7 |
| Inventive 1 | 75 | 18.75 | 6.25 | 0 | 8 |
| Inventive 2 | 75 | 18.75 | 6.25 | 3 | 8 |
| Inventive 3 | 75 | 18.75 | 6.25 | 6 | 8 |

To produce one-ply tissue product, the base sheets, produced above, were calendered using a steel-on-rubber roll combination (40 P&J hardness rubber roll) to a thickness of 6.6 mils±1.1 mil and the product wound into bath-tissue rolls of constant firmness, diameter and sheet count. The resulting one-ply tissue products were tested and exhibited the properties as shown in Tables 3 and 4, below.

TABLE 3

| Code | Basis Weight (gsm) | Caliper (μm) | Sheet Bulk (cc/g) | Delta Sheet Bulk | GMT (g/3") | GM Slope (kg) | Stiffness Index |
|---|---|---|---|---|---|---|---|
| Control 1 | 17.6 | 124.0 | 7.0 | — | 688 | 6.9 | 7.8 |
| Control 2 | 17.6 | 124.0 | 7.0 | — | 801 | 8.6 | 9.4 |
| Control 3 | 17.6 | 117.3 | 6.7 | — | 991 | 11.0 | 10.8 |
| Inventive 1 | 17.5 | 141.7 | 8.1 | 16% | 659 | 6.4 | 8.7 |
| Inventive 2 | 17.7 | 137.7 | 7.8 | 10% | 867 | 9.2 | 11.6 |
| Inventive 3 | 17.8 | 137.2 | 7.7 | 15% | 1040 | 11.7 | 12.8 |

TABLE 4

| Code | CD tensile (g/3") | CD stretch (%) | CD tear (gf) | CD Tear Index | Dry Burst (gf) |
|---|---|---|---|---|---|
| Control 1 | 498 | 4.8 | 5.41 | 1.09 | 269 |
| Control 2 | 608 | 4.8 | 6.40 | 1.05 | 315 |
| Control 3 | 773 | 4.8 | 7.73 | 1.00 | 345 |
| Inventive 1 | 501 | 4.6 | 6.09 | 1.22 | 283 |
| Inventive 2 | 696 | 4.7 | 7.27 | 1.04 | 337 |
| Inventive 3 | 848 | 5.1 | 9.10 | 1.07 | 414 |

While tissue webs, and tissue products comprising the same, have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the following embodiments:

In a first embodiment the present invention provides a single-ply wet-pressed tissue product comprising at least about 5.0 percent, by weight of the tissue product, *Agave* fibers, the product having a CD tensile greater than about 450 g/3" and sheet bulk greater than about 7.0 cc/g.

In a second embodiment the present invention provides the tissue product of the first embodiment having a sheet bulk from about 8.0 to about 11.0 cc/g.

In a third embodiment the present invention provides the tissue product of the first or the second embodiments wherein the product comprises less than about 20 percent, by weight of the tissue product, long wood pulp fibers.

In a fourth embodiment the present invention provides the tissue product of any one of the first through the third embodiments wherein the *Agave* fibers are high yield *Agave* pulp fibers.

In a fifth embodiment the present invention provides the tissue product of any one of the first through the fourth embodiments wherein the *Agave* fibers are high yield *Agave* pulp fibers derived from the mechanical processing of leaves of *Agave tequilana, Agave sisalana* or *Agave fourcroydes*.

In a sixth embodiment the present invention provides the tissue product of any one of the first through the fifth embodiments having a CD stretch from about 5.0 to about 8.0 percent.

In a seventh embodiment the present invention provides the tissue product of any one of the first through the sixth embodiments having a CD tear from about 8.0 to about 11.0 gf.

In an eighth embodiment the present invention provides the tissue product of any one of the first through the seventh embodiments having a basis weight from about 16 to about 20 grams per square meter (gsm).

In a ninth embodiment the present invention provides the tissue product of any one of the first through the eighth embodiments wherein the tissue product comprises a multi-layered tissue web having a middle layer and two outer layers wherein the *Agave* fiber is selectively disposed in the middle layer and the two outer layers are substantially free of *Agave* fiber.

In a tenth embodiment the present invention provides a method of increasing the bulk of a tissue web comprising the steps of: dispersing wood pulp fibers and *Agave* fibers to form a first fibrous slurry; dispersing wood pulp fiber to form a second fibrous slurry; pumping the first and second fibrous slurries to a multi-channel headbox; depositing the first and second fibrous slurries onto a foraminous surface to form a multi-layered fibrous web, wherein the *Agave* fiber is deposited on the dryer side of the web; pressing the multi-layered fibrous web against a felt to form a partially dewatered web having a consistency from about 40 to about 50 percent; adhering the partially dewatered web to a Yankee dryer; drying the web to a consistency greater than about 90 percent; creping the dried web from the Yankee dryer; and converting the dried web to a rolled tissue product having a sheet bulk greater than about 7.0 cc/g and a CD tensile greater than about 450 g/3".

In an eleventh embodiment the present invention provides the method of the tenth embodiment further comprising the steps of dispersing wood pulp fibers form a third fiber slurry and depositing the third fiber slurry on the felt side of the web thereby forming a three layered web wherein the felt and dryer side layers consist essentially of wood pulp fibers and the middle layer consists essentially of wood pulp fibers and *Agave* fibers and the *Agave* fibers comprise from about 5.0 to about 30 weight percent of the tissue product.

In a twelfth embodiment the present invention provides the method of the tenth or eleventh embodiments wherein the tissue product comprises from about 5.0 to about 30 percent, by weight of the tissue product, *Agave* fibers and from about 1.0 to about 20 percent long wood pulp fibers.

What is claimed is:

1. A method of increasing the bulk of a tissue web comprising the steps of:

a. dispersing wood pulp fibers having an average fiber length greater than about 2.0 mm and high yield *Agave* pulp fibers having an average fiber length less than 2.0 mm to form a first fibrous slurry;

b. dispersing wood pulp fiber to form a second fibrous slurry;

c. pumping the first and second fibrous slurries to a multi-channel headbox;

d. depositing the first and second fibrous slurries onto a foraminous surface to form a multi-layered fibrous web, wherein the *Agave* fiber is deposited on the dryer side of the web;

e. pressing the multi-layered fibrous web against a felt to form a partially dewatered web having a consistency from about 40 to about 50 percent;

f. adhering the partially dewatered web to a Yankee dryer;

g. drying the web to a consistency greater than about 90 percent;

h. creping the dried web from the Yankee dryer; and i. converting the dried web to a rolled tissue product having a sheet bulk greater than about 7.0 cc/g and a CD tensile greater than about 450 g/3".

2. The method of claim 1 further comprising the steps of dispersing wood pulp fibers to form a third fiber slurry and depositing the third fiber slurry to form a three layered web wherein the felt and dryer side layers consist essentially of wood pulp fibers and the middle layer consists essentially of wood pulp fibers and high yield *Agave* pulp fibers.

3. The method of claim 1 wherein the tissue product comprises from about 10 to about 40 percent, by weight of the tissue product, high yield *Agave* pulp fibers and from about 5.0 to about 20 percent, by weight of the tissue product, wood pulp fibers having an average fiber length greater than about 2.0 mm.

4. The method of claim 1 wherein the tissue product comprises a single ply and has a basis weight from about 16 to about 20 gsm.

* * * * *